United States Patent [19]

Welles

[11] Patent Number: 4,995,524

[45] Date of Patent: Feb. 26, 1991

[54] DRIPLESS SAUCER

[76] Inventor: Franklin G. Welles, 458 Cricket Cir., Talcottville, Conn. 06066

[21] Appl. No.: 503,327

[22] Filed: Apr. 2, 1990

[51] Int. Cl.[5] ..... B65D 19/22; B65D 23/06; A47G 19/22

[52] U.S. Cl. ..... 220/23.83; 215/100.5; 206/502; 248/346.1

[58] Field of Search ..... 215/100.5; 206/502; 220/23.83, 69, 23.86, 90.2, DIG. 5; 248/346.1

[56] References Cited

U.S. PATENT DOCUMENTS

| | | | |
|---|---|---|---|
| D. 198,701 | 7/1964 | Roehrig | 220/23.83 X |
| 1,949,285 | 2/1934 | Porter . | |
| 2,003,895 | 6/1935 | Martin . | |
| 2,518,368 | 8/1950 | Peters | 220/23.83 |
| 2,536,936 | 1/1951 | Holeman | 220/23.83 |
| 2,550,075 | 4/1951 | Martin . | |
| 2,621,496 | 12/1952 | O'Brien | 220/23.83 |
| 2,660,040 | 11/1953 | Babski | 220/23.83 |
| 2,664,193 | 12/1953 | Koch | 220/23.83 |
| 2,750,770 | 6/1956 | Berg | 220/23.83 |
| 2,765,640 | 10/1956 | Hood, Jr. | 220/23.83 |
| 2,770,957 | 11/1956 | Bronson | 220/23.83 |
| 3,008,600 | 11/1961 | Smith | 220/23.83 |
| 3,018,014 | 1/1962 | Opolion . | |
| 3,037,660 | 6/1962 | Roehrig | 220/23.83 |
| 3,257,024 | 6/1966 | Semanchik | 220/23.83 |
| 3,301,429 | 1/1967 | McClain | 220/23.83 |
| 3,357,590 | 12/1967 | Safford | 220/23.83 |
| 3,528,584 | 9/1970 | Piccirilli . | |
| 3,583,664 | 6/1971 | Kalina | 215/100.5 X |
| 4,750,632 | 6/1988 | Pieper | 220/23.83 |

FOREIGN PATENT DOCUMENTS

| | | | |
|---|---|---|---|
| 19337 | of 1900 | United Kingdom | 220/23.83 |
| 204375 | 9/1923 | United Kingdom | 220/23.83 |

*Primary Examiner*—Sue A. Weaver

*Attorney, Agent, or Firm*—McCormick, Paulding & Huber

[57] ABSTRACT

A saucer has a raised central portion having a plurality of planar surfaces disposed in a common plane with one another and are separated into sectors by a plurality of inlaid channels directed from the center of the raised central portion downwardly and outwardly from the common plane to an annularly extending trough surrounding the raised central portion. Disposed about the outer periphery of the raised central portion is an annular rim interrupted along its periphery by the inlaid channels, which rim providing an upwardly extending side wall cooperating with an associated one of the plurality of planar surfaces to provide both lateral and underlying support for a cup base sized and shaped to be received within the annular confines created by the interrupted rim.

10 Claims, 2 Drawing Sheets

DRIPLESS SAUCER

BACKGROUND OF THE INVENTION

This invention generally relates to a saucer upon which a cup, glass or other drinking vessel is supported and more particularly relates to an improved saucer construction wherein means are provided which divert spilt liquid collecting on the base of the drinking vessel into the saucer bottom so that the drinking vessel is supported on the saucer out of contact with liquid diverted away from it.

One problem associated with drinking tea, coffee or other beverage from cups supported on an associated saucer or other supporting dish is that some of the contents of the cup tend to spill into the plate or saucer as the user lifts and returns the cup back to its underlying plate or saucer while drinking its contents. It has been found that the liquid collecting at the bottom of the saucer often forms on the base of the cup and, when it is raised from the saucer this liquid drips from it as the user is drinking. This often undesirably results in staining of the table cloth or soiling of the user's own clothing as well as being the source of some social embarrassment.

Accordingly, it is the object of the present invention to provide a saucer having novel means of avoiding the aforementioned problems associated with cup and saucer dripping which allow the user to rest his or her cup on the saucer so that any liquid collecting on the base of the saucer is diverted away from it so that the bottom of the cup does not rest in any liquid which may collect in the underlying dish.

It is another object of the present invention to provide a saucer having means by which the bottom of a cup is elevated above spilled liquid, which means being esthetically pleasing and fashionable to a set table.

It is yet a further object of the present invention to provide a saucer of the aforementioned character which lends itself to being readily cleaned in the areas where liquid spillage may collect and dry.

Still a further object of the present invention is to provide a saucer of the foregoing type providing a support upon which a cup is brought to rest with enhanced supporting stability.

SUMMARY OF THE INVENTION

The present invention resides in an improved saucer construction for supporting a coffee or a tea cup placed on it wherein a means is provided for diverting liquid collecting at the base of the cup away from it and maintaining the base of the cup out of contact with the collected liquid. The means comprises a central raised portion integrally formed with the saucer which central raised portion being surrounded by a trough into which is collected spilt liquid from the coffee or tea cup. The raised central portion has a plurality of coplanar surfaces facing upwardly therefrom with each of the plurality of coplanar surfaces being separated from one another by a plurality of inclined channels extending radially outwardly relative to the center of the saucer and downwardly from the common plane and communicating with the trough such that liquid spilt from a cup and onto the central raised portion is diverted away from the cup base through the inclined channels and into the trough to maintain the base of the cup free from spilt liquid.

The invention further resides in an annularly extending rim formed on each of the plurality of coplanar surfaces and interrupted about its circumference by the channels extending therebetween such that the base of the cup rests upon the plurality of coplanar surfaces and in registry with the generally annularly extending rim formed thereon.

DETAILED DESCRIPTION OF THE PREFERRED EMBODIMENT

Figure 1:
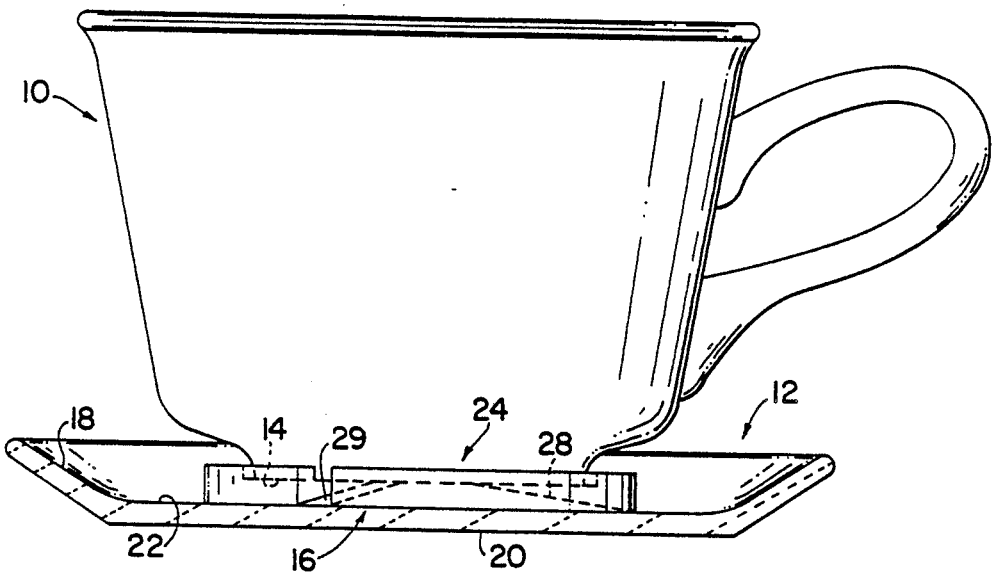
FIG. 1 is a partially fragmentary side elevation view of the saucer embodying the present invention shown supporting a cup placed on it.

Referring now to the drawings and in particular to FIG. 1, a cup 10 is shown resting upon a saucer embodying the present invention indicates generally as 12. The cup 10 can be any known type of cup having a generally annularly extending base portion 14. The saucer 12 is comprised of a generally annularly extending wall 18 disposed at an angle relative to a base 20 and has a means 16 adapted for receiving and elevating the base 14 of the cup 10 above the base 20 of the saucer 12 thereby forming a trough 22 surrounding it.

Figure 2:
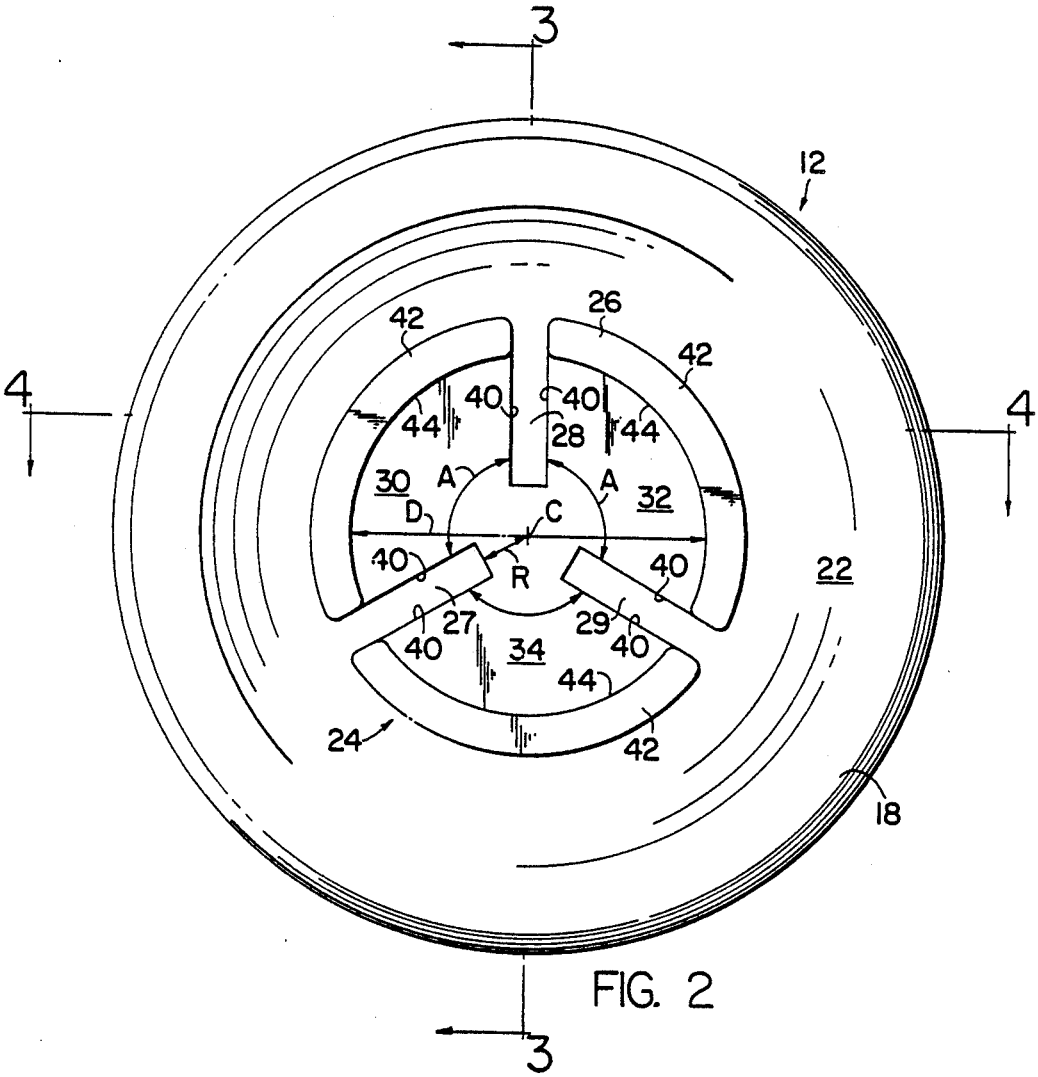
FIG. 2 is a top plan view of the saucer embodying the present invention.
Figure 3:
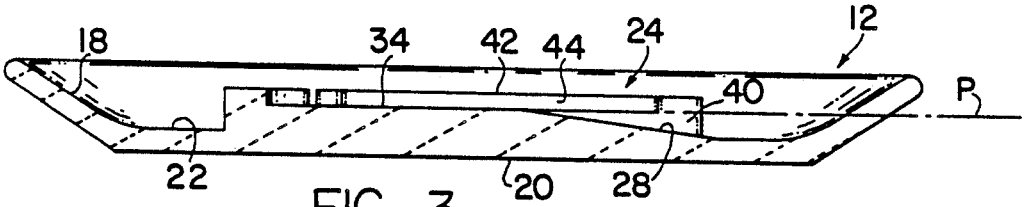
FIG. 3 is a vertical sectional view taken through the saucer along line 3—3 of FIG. 2.
Figure 4:
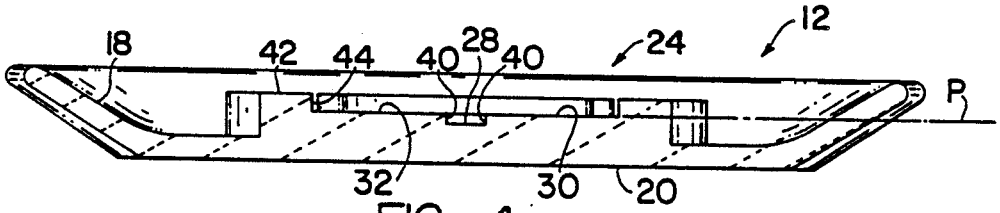
FIG. 4 is a vertical sectional view taken through the saucer along line 4—4 in FIG. 2.

In accordance with the invention, the means 16 provided for supporting the base 14 of the cup 10 above the trough 22 and for simultaneously diverting liquid collecting at the base 14 of the cup 10 into it is shown in FIG. 2. For this purpose, the means 16 comprises a generally raised central portion 24 having a rim 26 formed about it sized and shaped for receiving the base 14 of the cup 10 in registry therewith and has a plurality of radially disposed inlaid channels directed from the center C of the saucer 12 formed in the raised central portion 24 thereby dividing it into equal sectors. In the preferred embodiment of the invention, three channels 27, 28 and 29 divide the raised central portion 24 into three equal sectors of about 120 degrees each as represented by the reference letter A in FIG. 2. Each of these sectors has a respective substantially flat surface 30, 32, and 34 facing upwardly for engaging with the base 14 of the cup 10. As can be seen in FIG. 3, the surfaces 30, 32, and 34 are each disposed in a common plane P and thus provide an even support allowing the base 14 of the cup 10 to seat flushly and securely on the saucer 12.

Referring now to FIGS. 2 and 3, and in particular to the manner in which the saucer 12 is constructed so that liquid collecting at the base 14 of the cup 10 is diverted away from this region and into the trough 22 when the cup is seated on it, it should be seen that the inlaid channels 27, 28 and 29 are respectively directed radially outwardly and downwardly toward the trough 22 from an area on the raised central portion 24 lying generally symmetrically coincident with the center C and within the plane P. Thus, fluid passages are provided communicating between the surfaces 30, 32 and 34 and the trough 22 for diverting split liquid away from the cup 10.

As shown in FIG. 2, each of the inlaid channels 27, 28 and 29 begins at a fixed radius R from the center C, at which radius the upper end of each of the inlaid channels lies coincidentally within the common plane P and with each of the surfaces 30, 32 and 34. From this point, each of the inlaid channels 27, 28 and 29 slopes downwardly toward the trough 22 forming two juxtaposed side walls 40,40 in the raised central portion 24.

In accordance with a further aspect of the invention, the base 14 of the cup 10 is centered and held against lateral displacement on the raised central portion 24 by the generally annularly directed rim 42 extending above the plane P and being interrupted along its length by the channels 27, 28 and 29 to define the outer arcuate extent of each of the surface sectors 30, 32 and 34. The interrupted annular rim 42 is concentrically oriented about the center C to provide an inner upstanding arcuate wall 44 cooperating respectively with each of the planar surfaces 30, 32 and 34 to thereby securely hold the base 14 of the cup 10 against lateral movement along its outer vertical extent. The inner upstanding wall 44 circumscribes a circle about the raised central portion 24 having an inner diameter D, equally for example about 2 inches, which dimension being only slightly larger than that of the outer diameter of the cup base 14. This arrangement enhances the stability of the cup when it is placed on the saucer allowing the bottom surface of the cup to sit securely above the inlaid channels 27, 28 and 29 on the planar surfaces 30, 32, and 34 while nevertheless permitting drainage of liquid from the bottom of the cup downwardly through the inlaid channels and into the trough 22.

While the present invention has been described in the preferred embodiment, it should be understood that various modifications and substitutions to the structure of the saucer may be made. For example, although the liquid receptacle vessel in the preferred embodiment is a coffee or a tea cup, it is entirely possible to employ a saucer of the foregoing type with other kinds of liquid receptacles whose base is sized to conform with the diameter defined by the interrupted annular rim 42. Also, the saucer disclosed herein may be made from a variety of materials, such as ceramic, clay or plastic and it is entirely possible to form the saucer from such materials by appropriate methods, such as by molding.

Accordingly, the present invention has been described by way of illustration rather than limitation.

What is claimed is:

1. A saucer comprising:

a base integrally formed with a continuous side wall extending about said base, said continuous sidewall being disposed upwardly relative to said base at an angle;

a raised central portion integrally formed on said base and being spaced from said continuous side wall about its periphery to define a trough between said raised central portion and said continuous side wall;

means formed on said raised central portion for centering a vessel on it;

said raised central portion having a plurality of substantially planar surfaces facing upwardly therefrom, each of said plurality of substantially planar surfaces being disposed in a common plane with one another above said base; and said plurality of planar surfaces being separated from one another by a plurality of inlaid channels which are configured to be directed radially outwardly and downwardly toward said trough initially from an area on the raised central portion lying generally symmetrically coincident with the center of said saucer, said area being defined by a fixed radius taken from the center of said saucer and being disposed within said common plane such that each of said inlaid channels has a substantially constant width and communicates between said trough and said common plane to allow liquid to pass from said plurality of substantially planar surfaces downwardly through said inlaid channels and into said trough.

2. A saucer as defined in claim 1 further characterized in that the number of said inlaid channels is equal to the number of said plurality of planar surfaces and wherein each of said inlaid channels divides said raised central portion into equal sectors, which sectors defining a respective one of said plurality of planar surfaces.

3. A saucer as defined in claim 2 further characterized in that said centering means is disposed about said raised central portion and includes an annularly disposed rim interrupted about its periphery by said plurality of inlaid channels; and wherein said interrupted annular rim provides upstanding arcuate inner walls cooperating with said plurality of substantially planar surfaces to provide both a surrounding and an underlying support for receiving a receptacle therein.

4. A saucer as defined in claim 1 further characterized in that said centering means is disposed about said raised central portion and includes an annularly disposed rim interrupted about its periphery respectively by each of said plurality of inlaid channels; and wherein said interrupted annular rim provides an arcuate inner upstanding wall cooperating with one of said plurality of substantially planar surfaces to provide both a surrounding and an underlying base support for receiving a receptacle therein.

5. A saucer as defined in claim 4 further characterized in that said raised central portion is divided into three equal sectors by three inlaid channels each of which sectors defining one of said plurality of planar surfaces of said raised central portion.

6. A saucer as defined in claim 5 further characterized in that each of said sectors as defined by respective ones of said inlaid channels has an angle of approximately 120 degrees.

7. A saucer as defined in claim 5 further characterized in that said raised central portion is a generally circular element and said continuous side wall is annularly disposed about said raised central portion.

8. A saucer as defined in claim 7 further characterized in that said interrupted annular rim circumscribes about said raised central portion a circle having a diameter sized to receive in close proximity therewith the base portion of a cup.

9. A saucer as defined in claim 1 further characterized in that said raised central portion is a generally circular element and said continuous side wall is annularly disposed about said raised central portion.

10. In combination with a cup having a generally annularly extending base depending from its bottom, a saucer comprising:

a base integrally formed with a continuous said wall extending about said base, said continuous side wall being disposed upwardly relative to said base at an angle;

a raised central portion integrally formed on said base and being spaced from said continuous side wall about its periphery to define a trough between said raised central portion and said continuous side wall;

said raised central portion having a plurality of substantially planar surfaces facing upwardly therefrom, each of said plurality of substantially planar surfaces being disposed in a common plane with one another above said base;

said plurality of planar surfaces being separated from one another by a plurality of inlaid channels which are configured to be directed radially outwardly and downwardly toward said trough initially from an area on the raised central portion lying generally symmetrically coincident with the center of said saucer, said area being defined by a fixed radius taken from the center of said saucer and being disposed within said common plane such that each of said inlaid channels has a substantially constant width and communicates between said trough and said common plane to allow liquid to pass from said plurality of substantially planar surfaces downwardly through said inlaid channels and into said trough; and an interrupted rim extending generally circumferentially about said raised central portion and circumscribing a circle about said raised central portion having a diameter slightly larger than the outer diameter of said base of said cup such that said cup is securely supported on said saucer from below and along the sides of said cup base.

* * * * *